US006336665B1

(12) United States Patent
Kaufman

(10) Patent No.: US 6,336,665 B1
(45) **Date of Patent: *Jan. 8, 2002**

(54) BOOK CONSTRUCTED OF FOAM

(75) Inventor: Shari Kaufman, Westport, CT (US)

(73) Assignee: Innovative USA, Inc., Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/702,980

(22) Filed: Oct. 31, 2000

Related U.S. Application Data

(63) Continuation of application No. 09/564,152, filed on May 3, 2000, now Pat. No. 6,189,932, which is a continuation of application No. 09/149,781, filed on Sep. 8, 1998, now Pat. No. 6,070,909.

(51) Int. Cl.[7] ..... B42D 3/00

(52) U.S. Cl. ..... 281/37; 281/29; 281/38; 281/51; 402/4

(58) Field of Search ..... 281/29, 28, 22, 281/15.1, 21.1, 37, 36, 38, 51; 402/4

(56) References Cited

U.S. PATENT DOCUMENTS 4,280,241 A * 7/1981 Pfaff ..... 281/51
6,189,932 B1 * 2/2001 Kaufman ..... 281/37

* cited by examiner

*Primary Examiner*—Willmon Fridie, Jr.
(74) *Attorney, Agent, or Firm*—Hedman & Costigan, P.C.

(57) ABSTRACT

A book constructed of foam provided with manipulatives for use with enjoyment of the book is disclosed.

7 Claims, 7 Drawing Sheets

BOOK CONSTRUCTED OF FOAM

REFERENCE TO RELATED APPLICATIONS

This application is a continuation application which claims priority from U.S. utility application No. 09/564,152 filed May 3, 2000 now U.S. Pat. No. 6,189,932, which is a continuation appl. which claims priority from U.S. utility application No. 09/149,781 filed Sep. 8, 1998 which issued as U.S. Pat. No. 6,070,909.

The present invention relates to a book which is useful as a children's book. More particularly, the present invention is related to a book which is constructed of foam. Most particularly, the present invention is related to a book constructed entirely of foam which is suitable as a bath time book for children and which is suitable as a puzzle book and/or suitable as a standard reading book.

BACKGROUND OF THE INVENTION

A variety of books are currently on the market which are constructed for use by small children. These types of books generally are soft and only comprise a few pages.

Pfaff, U.S. Pat. No. 4,280,241 discloses a book with just a few leaves which is made by inserting the foam leaves into pockets of a plastic material. Similarly, Marks, U.S. Pat. No. 4,909,542 discloses a book in which a layer of a soft material is held between a covering material. Thus, in both Pfaff '241 and Marks '542 it is taught that it is necessary to cover the foam material.

Accordingly, neither Pfaff '241 nor Marks '542 are suitable for manufacture solely by die-cutting the pages. Both require the additional step of inserting the foam pages in a plastic material. This adds substantially to the cost of manufacturing the books. Additionally, the use of the plastic cover prevents the books from being usable as a bath toy which when wet will stick to the bath tub or tile wall surface. Also, the plastic cover prevents the book from being able to be adapted as a book having removable pieces, such as a puzzle book in which puzzle pieces are cut from the pages, and which can be used in the bath tub as a puzzle or on any flat surface.

Lippman, U.S. Pat. No. 5,096,204 and McQueny, U.S. Pat. No. 5,683,112 both disclose puzzle books, but with cardboard as a material of construction. Accordingly, such a book is not entirely useful or durable for very small children and is not at all suitable as a bath book.

Mention is also made of Nichols, U.S. Design Pat. No. 352,062 which discloses an infant teether book but does not teach or suggest a material of construction.

Accordingly, it would represent an advancement in the art of providing books for use with young children if a book was provided which is suitable as a bath book, is washable, is easily constructed by die-cutting the pages, is adaptable to have puzzle pieces or other shapes die cut therein, is soft and cuddly, and can also be used as a regular picture book.

SUMMARY OF THE PRESENT INVENTION

It is an object of the present invention to provide a book which is suitable as a bath book.

It is another object of the present invention to provide a book which is washable.

It is a further object of the present invention to provide a book with is constructed of die-cut pages.

It is still another object of the present to provide a book which is adaptable to have puzzle pieces or other shapes die cut therein.

It is still another object of the present to provide a book in which each puzzle pieces or shapes die cut therein is optionally able to float on water when fitted onto an interlocking flat stand, wherein said stand may also interlock with other stands of other said pieces or shapes.

It is another further object of the present invention to provide a book which is constructed of a soft material.

Accordingly, these objects and others are achieved by the book of the present invention which comprises a front cover; a back cover; at least one page between the front and back covers; and a means for binding said front cover, back cover and at least one page; wherein said front cover, said back cover and said at least one page are constructed of a material consisting of a foam.

In preferred embodiments the manipulatives are suitable for use with or related to the theme of the book.

DETAILED DESCRIPTION OF THE PRESENT INVENTION AND DESCRIPTION OF THE PREFERRED EMBODIMENTS

The following description of preferred embodiments is presented to illustrate the present invention and is not to be construed to limit the scope of the appended claims in any manner whatsoever.

Figure 1:
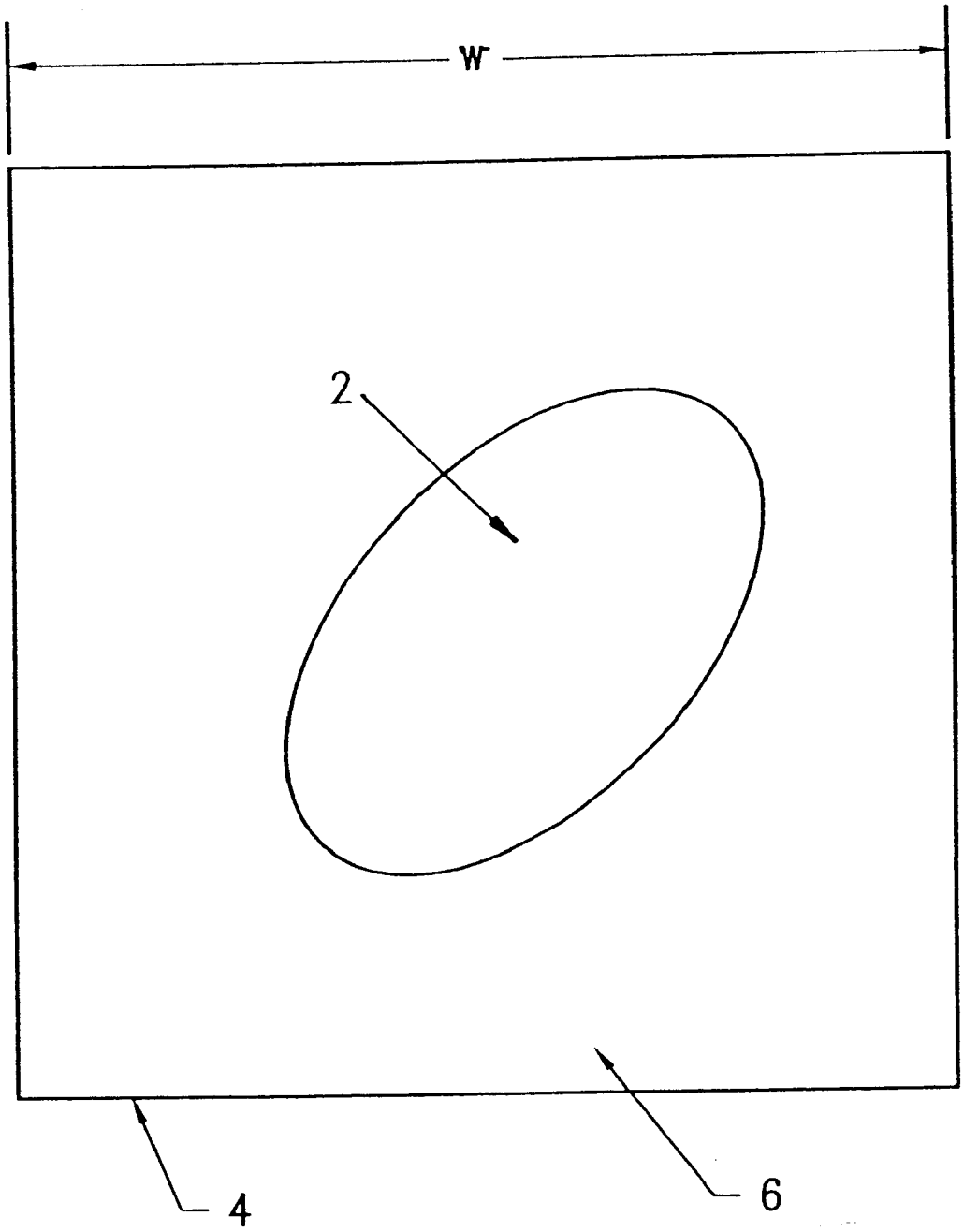
FIG. 1 depicts a top view of an embodiment of the present invention wherein the book is in a closed position.

Referring to FIG. 1, there is shown a top view of a book of the present invention in a closed position. The book 6 has, from a frontal perspective, a front cover 4 with an optional manipulative which in the embodiment of FIG. 1 is a shaped surface insert such as that indicated by the numeral 2.

Figure 1A:
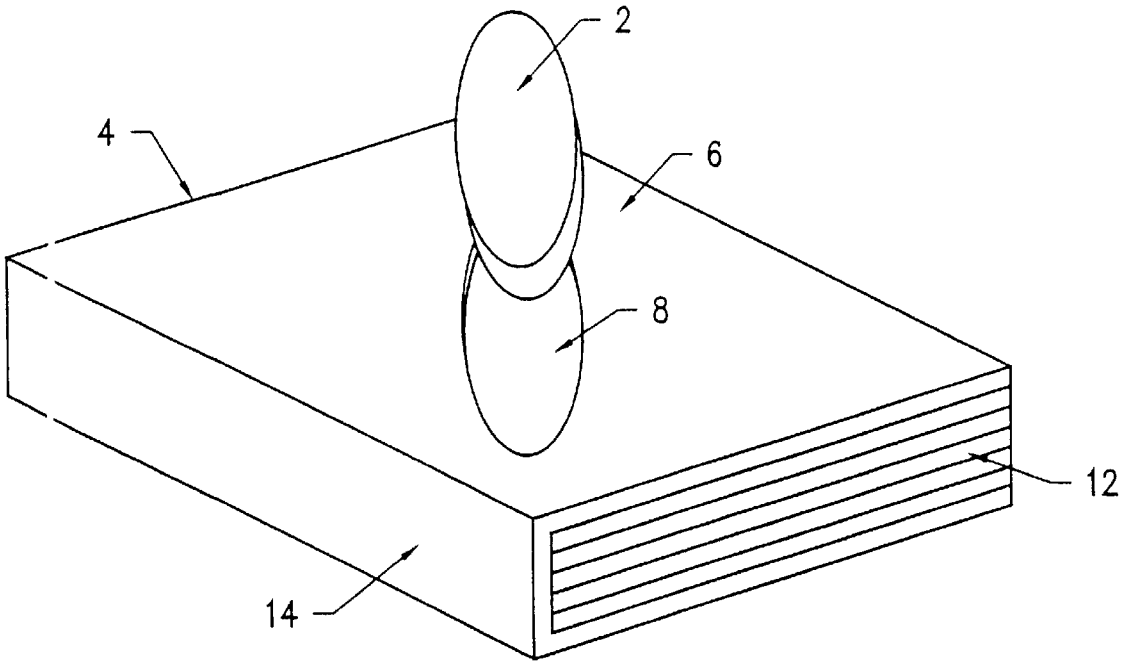
FIG. 1A depicts an offset view of an embodiment of the present invention wherein the book is in a closed position.

With reference to FIG. 1A, which shows an offset view of book 4 in the closed position, details the further elements of book 4 which comprise a plurality of page(s) 12 which are bound together via binding 14. The front cover 6 is substantially joined to a back cover 6A (not shown) via binding 14, which in turn binds die cut page(s) 12 to form one substantially unified book piece. Similar to the page(s) 12 the front and back covers (6 and 6A, respectively, as well as the binding 14, may be constructed of any foam-type material in any size and thickness known to those skilled in the art which provides sufficient rigidity, printability and useability. By way of example, the page(s) 12, covers 6 and 6A and binding 14 may be die cut or cast-formed, and may be made out of different types of materials known to those skilled in the art, however in the preferred embodiment, the foam for these components will be die-cut from a polymeric ethyl vinyl acetate having a thickness ranging from about 3 mm to about 12 mm thick. In particular, the polymeric ethyl vinyl acetate may be of either the high density type or the low density type, but in an especially preferred embodiment, the components will be formed from that of a high density type Ethyl Vinyl Acetate because it has been found that this material not only yields a product which is impervious to the degrading effects of water exposure, but is rugged enough to withstand the rambunctious play of young children, all while being flexible, relatively soft in texture and "cuddly" in nature, as well as washable, but most significantly, provides components which when wet, will adhere to the surface or sides of a bath tub or shower area and will float in water. Also in the preferred embodiment, such pages may be screen printed or colored as needed. In other preferred embodiments, the cover and pages are provided with a printing which has a related theme such as a story.

Figure 3:
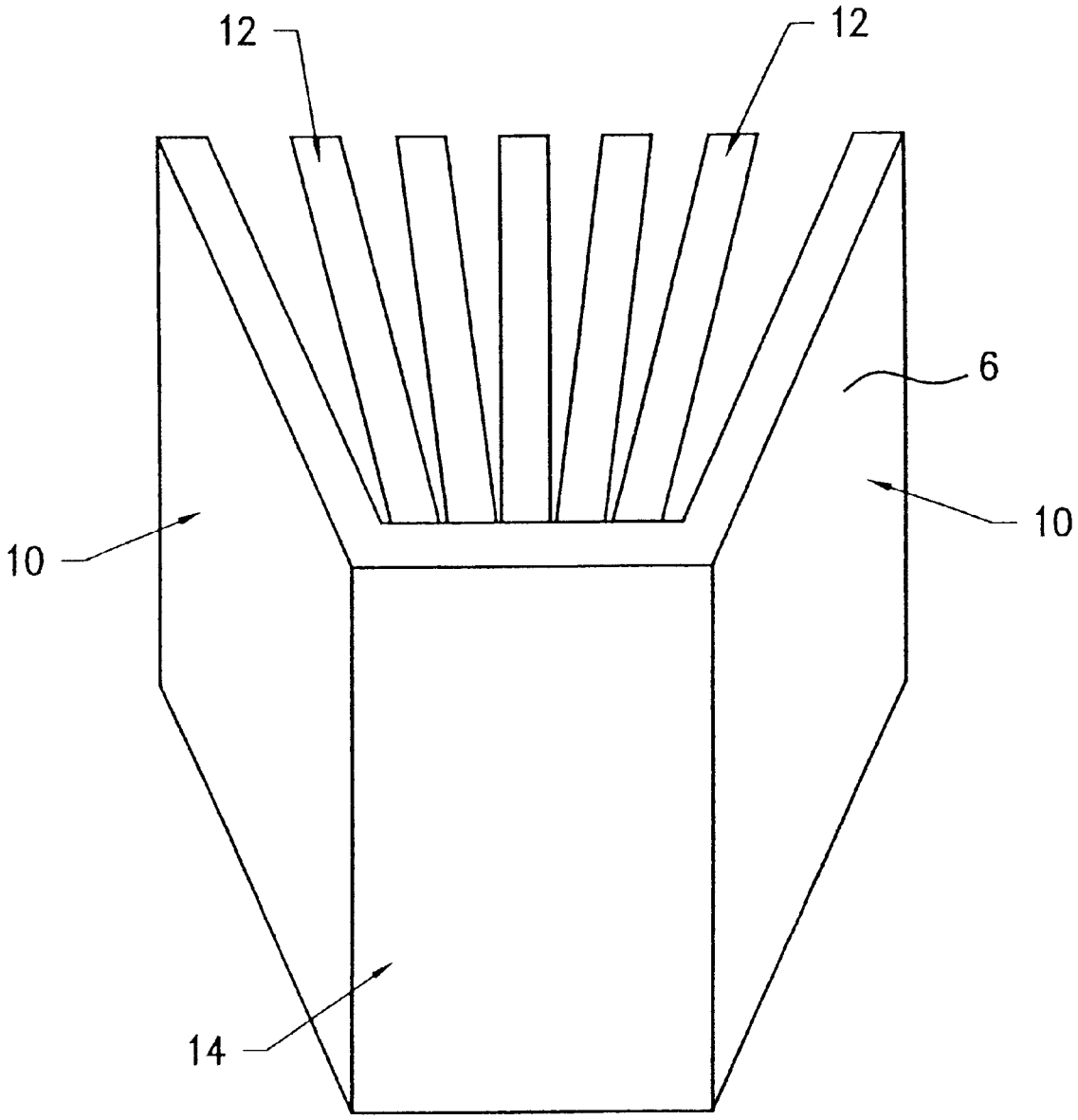
FIG. 3 depicts a birds eye view of an embodiment of the present invention wherein the book is in an open position.

With specific reference to binding 14, any binding known in the art may be employed in practicing the present invention, including ring binding, male/female mating-type bindings, spiral bindings, stitching, and slide-on type clip bindings. However, it is preferred that the page(s) 12 are all connected using a combination heat melt and/or glue adhesion methodology to the binding 14 as known to those skilled in the art, which itself is connected either integrally or otherwise to the front and back covers 6 and 6A. Thus, the embodiment of FIGS. 1A and 3, show the use of a preferred embodiment of a book of the present invention bound in such a fashion.

In another embodiment, a perfect binding may be employed which is similar to the binding shown in FIG. 1A except that the top cover 6 and the bottom cover 6A extend only across a portion of the top page and bottom page of the book.

While the entire book of the present invention may be die-cut of the aforementioned polymeric ethyl vinyl acetate and bound according to the above description, other embodiments may nonetheless augment the practicing of the invention. By way of example, one may form or cut the cover(s) 6 and 6A, as well as any page(s) into any desired size(s) or shape(s), such as animals, cartoon characters, people, dolls, etc. Where only the covers are shaped, the interior pages may be shortened so that they do not extend outside of the cover if desired.

Figure 2:
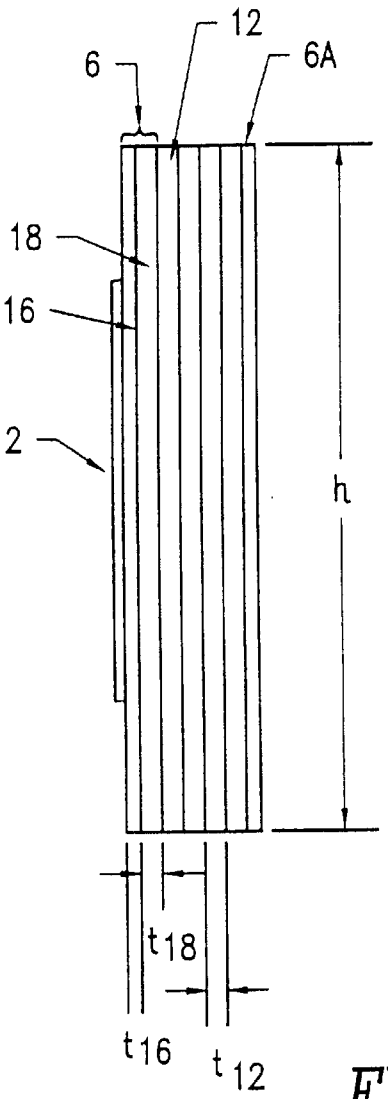
FIG. 2 depicts a side view of an embodiment of the present invention wherein the book is in a closed position.

Turning to FIG. 2, depicting a side view of an embodiment of the present invention in the closed position, shows front and back covers 6 and 6A as well as a plurality of individual interior pages, an exemplary one of which is labelled 12. Although it is contemplated that the respective thicknesses of the front cover, the interior pages and the back cover might be approximately equal, in one preferred embodiment of the present invention each of the aforementioned components may have a differing thickness, depending on whether one wishes to provide the given page(s) or cover(s) with the above-mentioned insert or puzzle piece manipulatives. While all page(s) 12 and cover(s) 6, 6A and the binding are preferably die cut to the extent that one forms an individual component from a raw sheet or stock of foam, components such as page(s) and cover(s) which provide manipulative(s) 2 (FIG. 1A) are further die-cut so as to form the desired manipulative shape, thereby leaving an analogously shaped hole 8 (FIG. 1A) in the page(s) or cover(s). In a preferred embodiment, manipulative 2 is cut from hole 8 (not shown in FIG. 2) of holed wall portion 16 such that the manipulative is provided with a backing wall portion 18. Such cooperation between the manipulative and the analogous hole or recess in any given component of the book will, in an especially preferred embodiment, fit together in a puzzle-like fashion. Regardless of the particular embodiments of the components and manipulatives of the book, the preferred embodiment of the present invention contemplates use of a foam, which when wet, will stick to bathroom surfaces such as bath tubs, shower walls, and the like and will float in water.

When properly adhered by melting and/or glue adhesion, provision of backing wall portion 18 on holed wall portion 16 provides a way for manipulative 2 to be placed in the analogously shaped hole 8 of holed wall portion 16 without being pushed completely through from one side of holed wall portion 16 to another. Accordingly, when providing for backing wall 18, the total thickness of a given page(s) or cover(s) may be adjusted to reflect the combined thickness $t_{16}$ of holed wall portion 16 with the thickness $t_{18}$ of backing wall portion 18. Similarly, the thickness $t_{12}$ of the given page(s) 12 may vary depending on the inclusion of manipulatives on a page. Although not directly pictured, $t_{12}$ may of course—much like the example shown in front cover 6—have a combined thickness analogous to that pictured in $t_{16}$ and $t_{18}$.

The aforementioned manipulatives may be of varying thickness, and also, may be puzzle piece shaped so as to fit together with each other in a puzzle like fashion outside of the book such as when stuck to the bath tub wall. In another embodiment, it is also possible to shape the actual pages themselves in such a way as to provide for pages that fit into the binding in a puzzle-like fashion. In these embodiments, the edges of the pages are provided with dovetails and/or mortises or other suitable interlocking means which cooperate with mortises and/or dovetails or other interlocking means on the binding piece. Of course, in such a non-glued page and binding embodiment, the pages are removable and preferably themselves can fit together in a puzzle like fashion.

FIG. 3 depicts a birds eye view of a preferred embodiment of the present invention in an open position without any applicable differences in page thickness being drawn to scale. It is contemplated that the nature of the present invention provides for book which exhibits the proper size, page thickness, tactility, softness and flexibility to be repeatedly opened by the small, tender fingers of children. Nevertheless, the present invention also provides for a rugged construction which maintains the integrity of the structure throughout its lifetime.

Figure 4:
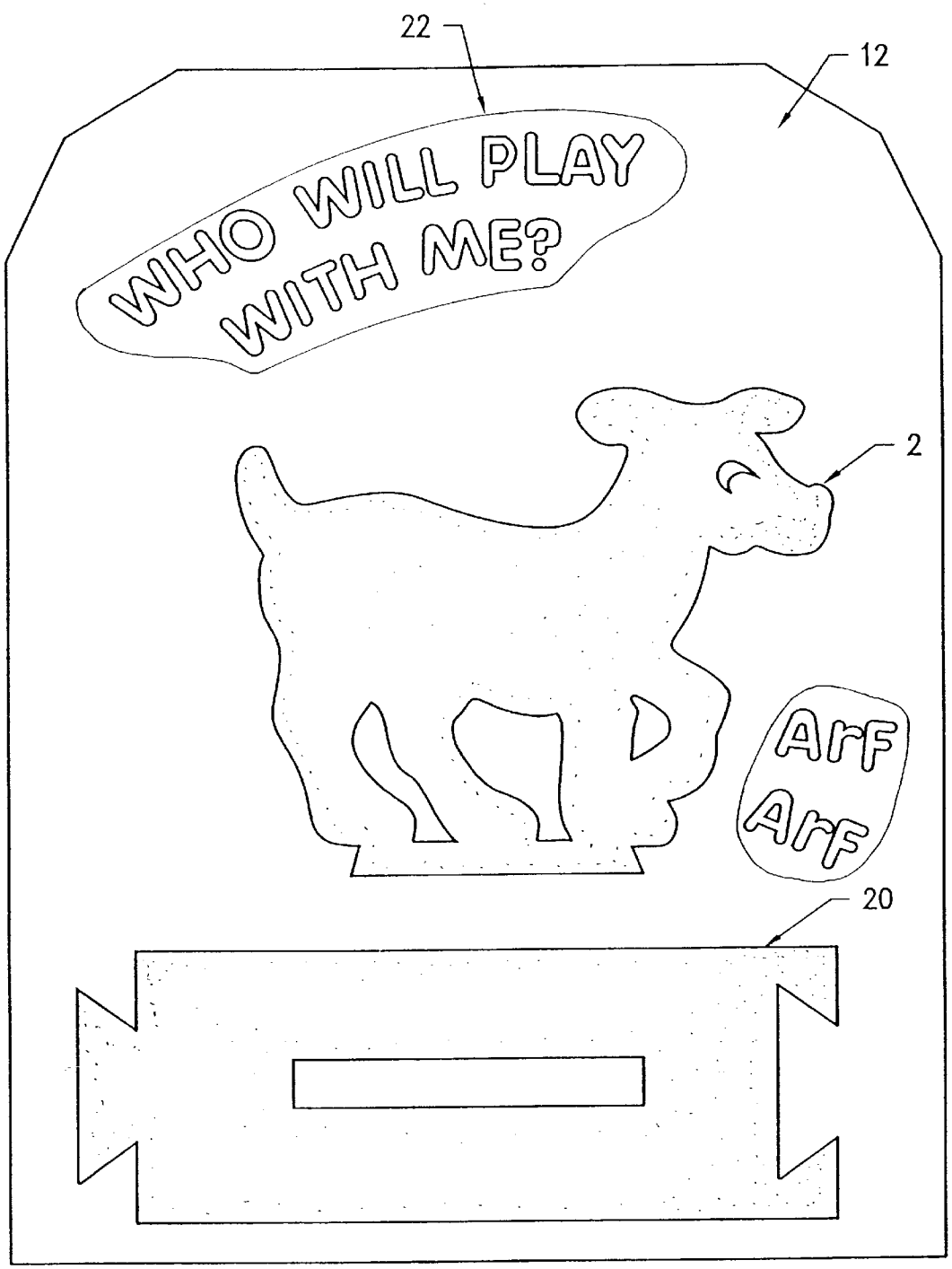
FIG. 4 depicts a frontal view of a book page which is provided with puzzle pieces or shapes die cut therein as fitted into the page but is optionally able to float on water when fitted onto an interlocking flat stand, wherein said stand may also interlock with other stands of other said pieces or shapes if removed from therein and assembled externally to the page.

FIG. 4 depicts a frontal view of a preferred book page which is provided with puzzle pieces or shapes die cut as manipulatives 2 fitted thereinto the page 12. Such manipulatives 2, as well as the interlocking flat stand 20, may optionally be provided on the page(s) 12, cover(s) 6, or even the binding 14 in order to maximize space savings as needed to allow for additional artwork or text 22. In addition, manipulatives 2 are optionally able to float in a substantially erect fashion on water when fitted onto an interlocking flat stand 20, as shown infra, in FIG. 7.

Figure 5:
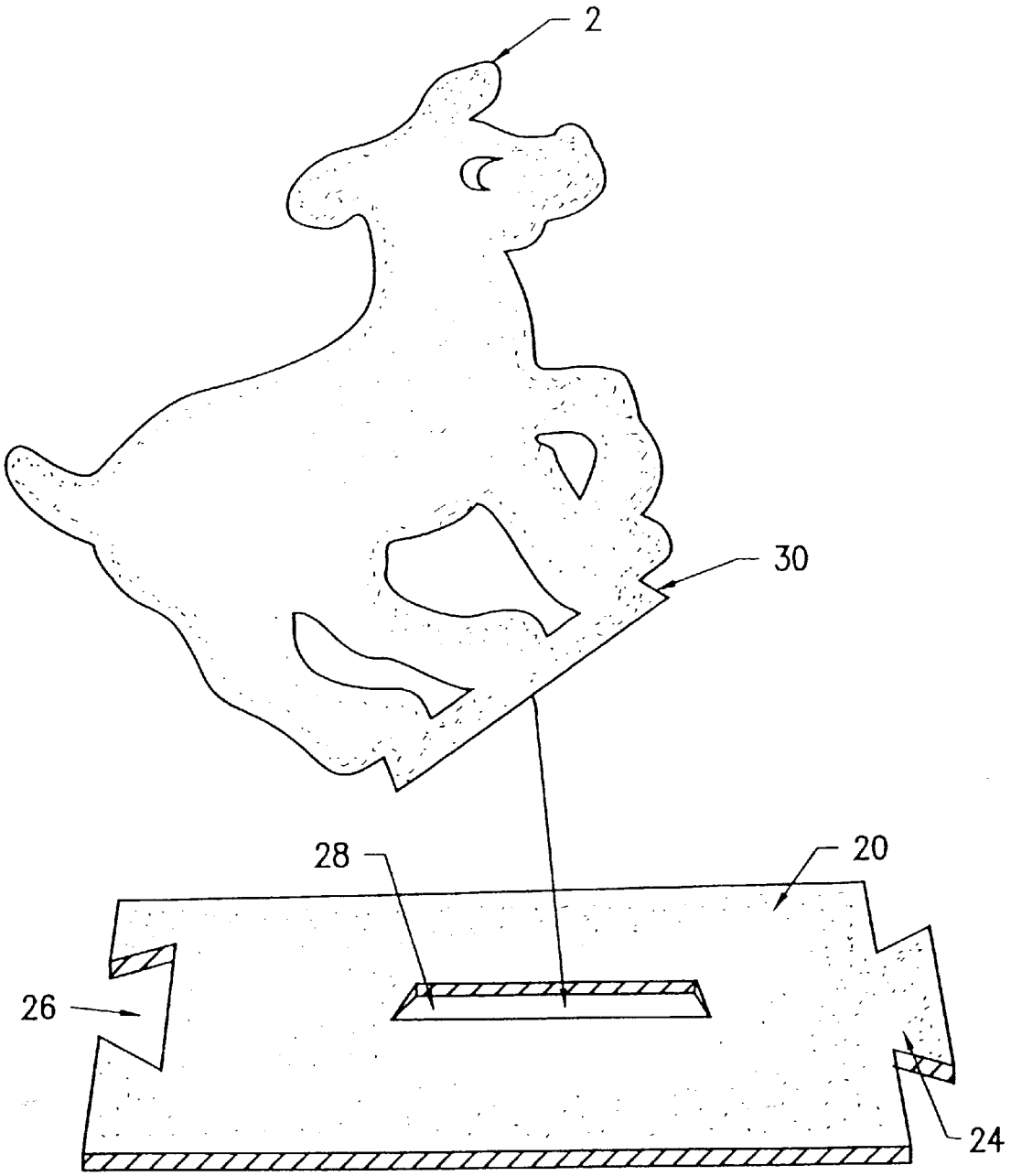
FIG. 5 depicts a view of an embodiment of the present invention wherein the manipulative and interlocking flat base are extracted from the components of the book, and are ready for cooperative snap-fit interlocking.

FIG. 5 depicts the preferred embodiment of cooperation between manipulative 2 and interlocking flat stand 20. As seen by the demonstrative arrow depicted therein, the preferred embodiment provides for the interlocking base 30 of manipulative 2 to snap fit into snap fit hole 28 in a cooperative way so as to provide a substantially perpendicular profile of manipulative 2 in relation to interlocking flat stand 20.

Figure 6:
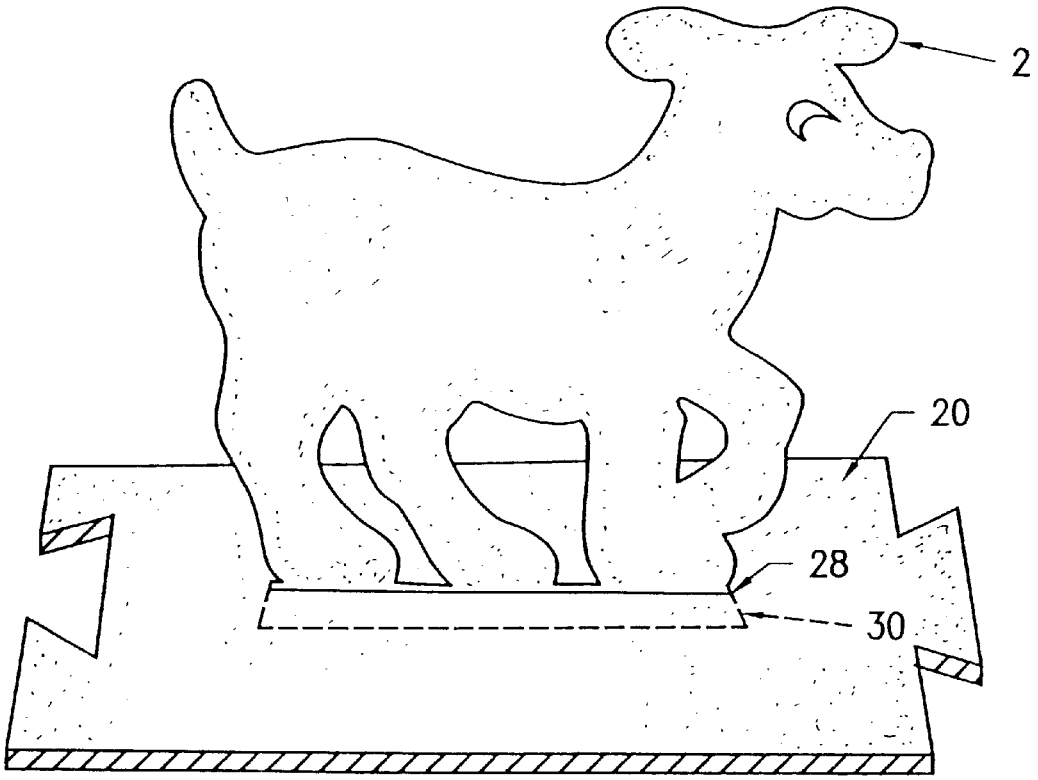
FIG. 6 depicts a view of the manipulative and interlocking flat base, extracted from the components of the book, and cooperatively snap-fit together in a substantially perpendicular manner.

FIG. 6 depicts manipulative 2 snap fitted in a substantially perpendicular manner into interlocking flat stand 20.

Figure 7:
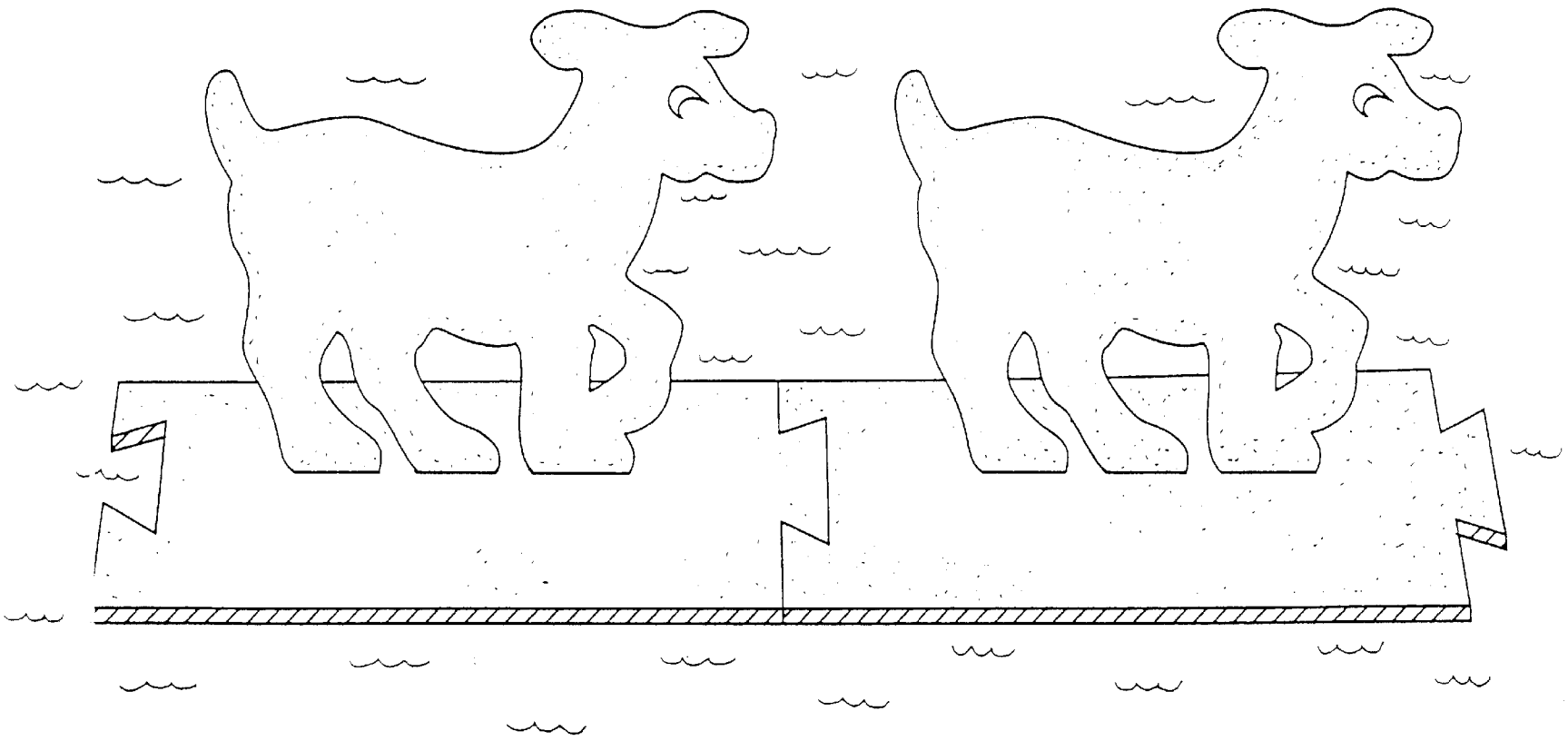
FIG. 7 depicts a view of the manipulative and interlocking flat base, extracted from the components of the book, and cooperatively snap-fit together in a substantially perpendicular manner, and cooperatively mated together from flat base to flat base so as to enable the pieces to float in water with the manipulatives substantially perpendicular to the water surface.

FIG. 7 depicts an embodiment of manipulatives 2 which are able to float in a substantially erect fashion on water when fitted onto an interlocking flat stand 20. As cross-referenced with FIG. 5, the interlocking flat stand 20 is provided with an interlocking means such as male locking piece 24 and female locking piece 26 such that the flat stand 20 stand may interlock with other flat stands 20 when removed from either the book page 12, cover page(s) 6, 6A, or binding 14 and assembled externally so as to cooperate with the interlocking manipulatives 2 to provide a substantially erect (i.e., substantially perpendicular to the water surface plane) floating profile for the manipulative 2. As is the case in the snap fit relation described in detail in FIG. 5 above, with respect to the interlocking flat stands 20, it may be pointed out that the interconnecting pieces may effectively interconnect in other methods known in the art may be employed, such as reciprocal velcro pads, etc.

Many variations of the present invention will suggest themselves to those skilled in the art in light of the above-detailed description. For example, the manipulatives for use with the present invention may comprise small plastic figures, small stuffed animals, game pieces and the like. Additionally, it is contemplated that the manipulatives may be die cut in a manner such that the manipulatives can fit within one another in a nesting-like fashion. All such obvious modifications are within the full intended scope of the appended claims.

The above referenced patents are hereby incorporated by reference.

What is claimed is:

1. A book having components, said book components comprising:

a front cover;

a back cover;

optionally, at least one page between the front and back covers;

a binding means;

wherein said front cover, back cover, and optional page are constructed of a material consisting of foam; and said front cover, back cover, and at least one page being attached along one side to said binding means; and wherein one or more of said front and back covers or pages are further die cut to contain a removable manipulative portion.

2. A book as defined in claim 2 wherein said manipulative piece cooperates with a recess of the binding of said in a puzzle-like fashion.

3. A book as defined in claim 2 wherein said binding means comprises a foam spine attached to all other components of the book via a heat melt adhesive.

4. A book as defined in claim 2 wherein said binding means further comprises a foam spine attached to all other components of the book via a glue.

5. A book as defined in claim 2 wherein said components of said book are silk screened.

6. A book as defined in claim 2 wherein said components of said book are die cut in the shape of animals.

7. A book as defined in claim 2 wherein said front and back covers of said book are die cut in the shape of animals.

* * * * *

UNITED STATES PATENT AND TRADEMARK OFFICE

CERTIFICATE OF CORRECTION

PATENT NO. : 6,336,665 B1
DATED : January 8, 2002
INVENTOR(S) : Shari Kaufman

It is certified that error appears in the above-identified patent and that said Letters Patent is hereby corrected as shown below:

Column 6,
Lines 22, 25, 28, 31, 33 and 35, rewrite "claim 2" to read -- claim 1 --.
Line 23, rewrite "said in" to read -- said book in --.
Line 37, insert the following claim: -- 8. A book as defined in claim 1 wherein said foam sticks to bathroom surfaces when wet. --

Signed and Sealed this

Sixth Day of May, 2003

JAMES E. ROGAN
*Director of the United States Patent and Trademark Office*